US012650270B2

(12) United States Patent
Attarwala et al.

(10) Patent No.: US 12,650,270 B2
(45) Date of Patent: Jun. 9, 2026

(54) PHASE CHANGE MATERIAL-COATED HEAT EXCHANGE TUBES

(71) Applicant: Henkel AG & Co. KGaA, Duesseldorf (DE)

(72) Inventors: Shabbir Attarwala, Simsbury, CT (US); Ikpreet Grover, Redwood City, CA (US); Timothy Graver, Cheshire, CT (US); Jesse Davis, Hartford, CT (US); Joseph B. Schulz, Newington, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 495 days.

(21) Appl. No.: 17/196,342

(22) Filed: Mar. 9, 2021

(65) Prior Publication Data

US 2021/0190439 A1 Jun. 24, 2021

Related U.S. Application Data

(63) Continuation of application No. PCT/US2019/050561, filed on Sep. 11, 2019.
(Continued)

(51) Int. Cl.
*F28D 20/00* (2006.01)
*F25B 39/00* (2006.01)
(Continued)

(52) U.S. Cl.
CPC ..... *F28D 20/023* (2013.01); *F25B 39/00* (2013.01); *F25B 2700/21163* (2013.01);
(Continued)

(58) Field of Classification Search
CPC ..... F28D 20/02; F28D 20/023; F28D 20/021; F28D 1/0477; F25B 39/00;
(Continued)

(56) References Cited

U.S. PATENT DOCUMENTS 5,220,887 A * 6/1993 Hiddleston ..... F24H 1/181 122/18.31
2011/0108241 A1* 5/2011 Driscoll ..... C04B 18/021 252/73
(Continued)

FOREIGN PATENT DOCUMENTS

CN 206876030 U 1/2018
DE 102018000673 A1 * 11/2018
(Continued)

OTHER PUBLICATIONS

Salunkhe, Pramod B. et al. "A review on effect of phase change material encapsulation on the thermal performance of a system." Renewable and Sustainable Energy Reviews, 16, (2012), pp. 5603-5616.

*Primary Examiner* — Harry E Arant
(74) *Attorney, Agent, or Firm* — Steven C. Bauman

(57) ABSTRACT

Disclosed herein is a hollow tube comprising two ends, one end adapted to receive a fluid and the other end adapted to discharge the fluid, where the hollow tube has an interior surface and an exterior surface and a curable composition is disposed about at least a portion of the exterior surface of the hollow tube, where the curable composition comprises before cure: a curable component, a thermally conductive component, a phase change material, and a cure system.

21 Claims, 2 Drawing Sheets

Related U.S. Application Data

(60) Provisional application No. 62/729,571, filed on Sep. 11, 2018.

(51) Int. Cl.
*F28D 20/02* (2006.01)
*F28F 1/32* (2006.01)

(52) U.S. Cl.
CPC ..... *F28D 20/021* (2013.01); *F28F 1/32* (2013.01); *F28F 2245/00* (2013.01)

(58) Field of Classification Search
CPC ..... F25B 2339/046; F25B 2700/21162; F28F 13/182; F28F 2245/00; F28F 1/32; Y02E 60/14
See application file for complete search history.

(56) References Cited

U.S. PATENT DOCUMENTS

| | | | | |
|---|---|---|---|---|
| 2014/0262189 | A1* | 9/2014 | Attarwala ..... | C08G 18/1825 285/285.1 |
| 2015/0291868 | A1 | 10/2015 | Rajagopalan et al. | |
| 2016/0223269 | A1 | 8/2016 | Hartmann | |
| 2017/0059080 | A1 | 3/2017 | Zheng et al. | |

FOREIGN PATENT DOCUMENTS

| | | | | |
|---|---|---|---|---|
| EP | 0934357 | B1 | 11/2004 | |
| EP | 3757484 | A1 * | 12/2020 | ..... F25B 39/04 |
| JP | 2005-054064 | A | 3/2005 | |
| KR | 20-0427596 | Y1 | 9/2006 | |

* cited by examiner

PHASE CHANGE MATERIAL-COATED HEAT EXCHANGE TUBES

BACKGROUND

Field

This invention generally relates to a coating, including a phase change material, for application onto a heat exchange tube for improving heat exchange efficiency.

Brief Description of Related Technology

Refrigeration units typically include a compressor, a condenser, an evaporator, and a refrigeration compartment. A refrigeration unit typically functions by passing refrigerant through the compressor, condenser, and evaporator to cool down the air inside of the refrigeration compartment. The compressor and condenser are generally located outside of the refrigeration compartment, while the evaporator is inside of the refrigeration compartment. In a typical refrigeration unit, the condenser transitions the refrigerant into its liquid state and emits condensation heat. A fan may be used to pass air across the condenser and compressor and increase the efficiency in removing heat from exterior surfaces of the compressor and condenser. The evaporator is within the refrigeration compartment such that heat from the refrigeration compartment is absorbed into the refrigerant in the evaporator and the refrigeration compartment is cooled.

Thus, the heat is absorbed within the refrigeration compartment by the evaporator and withdrawn outside of the refrigeration compartment by the condenser.

It is desirable to absorb and release heat as efficiently as possible throughout the refrigeration cycle, in the evaporator and the condenser. For this purpose, many different refrigerator designs have been developed. Some refrigerator designs include different condenser designs to improve the efficiency of heat removal such as wire tube, finned, and spiral condensers.

Increased condenser tube lengths are also employed to increase heat transfer efficiency. However, increasing the length of the condenser tube decreases the compactness of the condenser, which increases the required size of the refrigeration unit itself. Also, increasing a length of the condenser may introduce additional labor and material costs, present additional surface area for potential leaks, and negatively affect the pressure drop of the refrigerant. Further, this may lead to undesirable rattling noises and decreased reliability of the condenser. Further still, many conventional condenser systems require periodic maintenance such as cleaning the coil of dust, dirt, and other debris that settles on the surface of the coil, decreases heat transfer efficiency and increases an operating temperature of the condenser system.

In response, the present technology has proposed using liquid filled pouches to enhance the efficiency of heat transfer by the condenser. The liquid filled pouches may improve the efficiency of the condenser by absorbing the emitted heat more effectively than ambient air. One problem faced while using the liquid filled pouches is that there is no thermal contact with the condenser coil, so the heat transfer is not significantly more efficient than when ambient air is used.

So, while others have tried to overcome these issues, few have succeeded.

Accordingly, it would be desirable to provide a system that increases heat transfer efficiency without increasing the size of the components in a heat exchange system such as a refrigerator system.

SUMMARY

In one aspect, a hollow tube is provided that is coated with a curable composition. The hollow tube comprises two ends, one end adapted to receive a fluid and the other end adapted to discharge the fluid, and an interior surface and an exterior surface, wherein the composition is disposed about at least a portion of the exterior surface. The composition comprises either A.
- i) a curable component;
- ii) a thermally conductive component;
- iii) a phase change material; and
- iv) a cure system, or B.
- i) a binder component;
- ii) a thermally conductive component;
- iii) a phase change material; and
- iv) water.

In another aspect, a refrigeration unit comprising a compressor, a condenser coil, and at least one evaporator coil is disclosed. The hollow tube described above is the condenser coil of the refrigeration unit.

In another aspect, a domestic refrigeration appliance is disclosed herein that includes the refrigeration unit described above.

DETAILED DESCRIPTION

Figure 1:
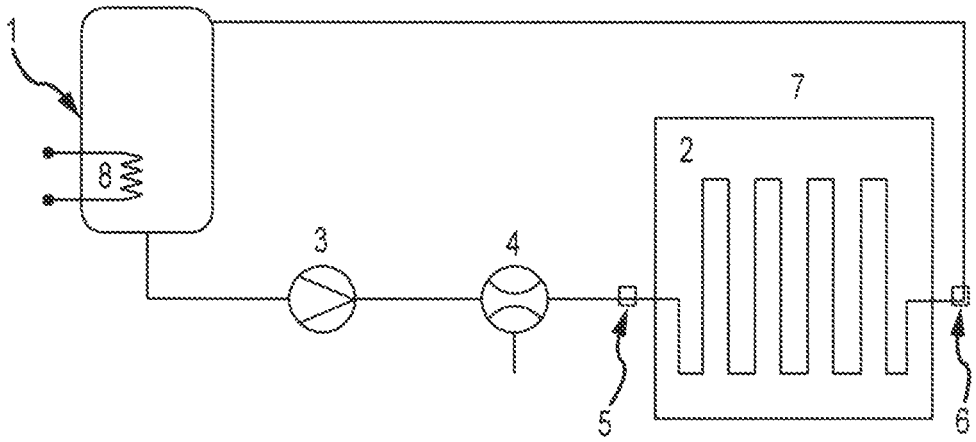
FIG. 1 depicts a refrigeration unit.

Disclosed herein is a hollow tube coated with a curable composition to increase heat transfer efficiency through the hollow tube. The hollow tube comprises, one end adapted to receive a fluid and the other end adapted to discharge the fluid, and has an interior surface and an exterior surface. A composition is disposed about at least a portion of the exterior surface of the hollow tube. The composition comprises either A.
- i) a curable component;
- ii) a thermally conductive component;
- iii) a phase change material; and
- iv) a cure system, or B.
- i) a binder component;
- ii) a thermally conductive component;
- iii) a phase change material; and
- iv) water.

The hollow tube may be constructed in variety of dimensions and diameters, and from a variety of materials. For example, the hollow tube may be metal, and the metal may be selected from aluminum, steel, copper, or combinations or alloys thereof. The hollow tube may be curved, straight, or have some portions that are curved and other portions that are straight. The dimensions of the hollow tube may also be varied based on the end use of the hollow tube. For example, if the hollow tube is used as a condenser coil in a household refrigerator, the hollow tube may be 0.02-0.4 inches in outer diameter, and 1-100 feet, for example 25-75 feet, specifically 54 feet in total length. The dimensions and geometry of the hollow tube may be adjusted based on the application without limitation.

The curable composition is disposed about at least a portion of the exterior surface of the hollow tube. The curable composition may be applied to the tube by spray coating, painting, or any methods suitable for applying a coating. The curable composition is used to enhance heat exchange across the hollow tube. As such, it may be beneficial to coat the entirety of the hollow tube with the curable composition to enhance heat exchange across the entire length of the hollow tube. In a particularly useful embodiment, 95% or more of the surface area of the hollow tube is coated with the curable composition.

The curable composition is thermally conductive, securely disposed around the hollow tube, capable of withstanding temperature change, and able to absorb and store latent heat. The curable composition comprises, before cure, a curable component, a thermally conductive component, a phase change material, and a cure system. The curable composition may further optionally comprise an anti-oxidant, a corrosion inhibitor, a UV-stabilizer, a thermostabilizer, or a flame retardant. The curable composition may also include wetting agents, dispersing agents, rheological modifiers, emulsifiers, pH modifiers to enhance emulsion stability, coalescing solvents, or anti-flocculation additives.

The curable component of the curable composition may be light curable such that the curable composition may be light cured onto the hollow tube. The curable component may also be moisture or heat curable. The curable component may cure through one cure mechanism (such as is triggered through exposure to light) or multiple cure mechanisms (such as initially triggered through exposure to light and then exposure to heat and/or moisture). The curable component should be selected such that after cure it has high strength, humidity resistance and temperature resistance within the operating conditions of the hollow tube.

As such, the curable component may comprise an epoxy resin component, a (meth)acrylate component, a polyurethane matrix, a hot melt, or a silicon component.

The epoxy resin component may be selected from one or more saturated, unsaturated, cyclic or acyclic, aliphatic, alicyclic, aromatic or heterocyclic polyepoxide compounds.

In general, a large number of polyepoxides having at least about two 1,2-epoxy groups per molecule are suitable for use herein. The polyepoxides may be saturated, unsaturated, cyclic or acyclic, aliphatic, alicyclic, aromatic or heterocyclic polyepoxide compounds. Examples of suitable polyepoxides include the polyglycidyl ethers, which are prepared by reaction of epichlorohydrin or epibromohydrin with a polyphenol in the presence of alkali. Suitable polyphenols therefor are, for example, resorcinol, pyrocatechol, hydroquinone, bisphenol A (bis(4-hydroxyphenyl)-2,2-propane), bisphenol F (bis(4-hydroxyphenyl)-methane), bisphenol S, biphenol, bis(4-hydroxyphenyl)-1,1-isobutane, 4,4'-dihydroxy-benzophenone, bis(4-hydroxyphenyl)-1,1-ethane, and 1,5-hydroxy-naphthalene. Other suitable polyphenols as the basis for the polyglycidyl ethers are the known condensation products of phenol and formaldehyde or acetaldehyde of the novolac resin-type.

Other polyepoxides that are suitable for use herein are the polyglycidyl ethers of polyalcohols or diamines. Such polyglycidyl ethers are derived from polyalcohols, such as ethylene glycol, diethylene glycol, triethylene glycol, 1,2-propylene glycol, 1,4-butylene glycol, triethylene glycol, 1,5-pentanediol, 1,6-hexanediol or trimethylolpropane.

Still other polyepoxides are polyglycidyl esters of polycarboxylic acids, for example, reaction products of glycidol or epichlorohydrin with aliphatic or aromatic polycarboxylic acids, such as oxalic acid, succinic acid, glutaric acid, terephthalic acid or a dimeric fatty acid.

And still other epoxides are derived from the epoxidation products of olefinically-unsaturated cycloaliphatic compounds or from natural oils and fats.

Particularly desirable are liquid epoxy resins derived from the reaction of bisphenol A or bisphenol F and epichlorohydrin. The epoxy resins that are liquid at room temperature generally have epoxy equivalent weights of from 150 to about 480.

The (meth)acrylate component may be selected from one or more monofunctional, multifunctional, linear aliphatic, branched aliphatic, cycloaliphatic, aromatic, alkoxylated alkyl and aryl groups. The (meth)acrylates that may be used in the curable composition in accordance with this invention include a wide variety of materials represented by $H_2C{=}CGCO_2R$, where G may be hydrogen, halogen or alkyl of 1 to about 4 carbon atoms, and R may be selected from alkyl, cycloalkyl, alkenyl, cycloalkenyl, alkaryl, aralkyl or aryl groups of 1 to about 16 carbon atoms.

More specific (meth)acrylates particularly desirable for use herein include polyethylene glycol di(meth)acrylates, trimethylolpropylane tri(meth)acrylate, bisphenol-A di(meth)acrylates, such as ethoxylated bisphenol-A (meth)acrylate ("EBIPMA") and tetrahydrofuran (meth)acrylates and di(meth)acrylates, isobornyl acrylate, hydroxypropyl (meth) acrylate, and hexanediol di(meth)acrylate. Of course, combinations of these (meth)acrylates may also be used.

The polyurethane component may be selected from one or more di- and tri-isocyanates, such as toluene diisocyanate and methylene diphenyl diisocyanate, aliphatic and cycloaliphatic isocyanates, together with polyols, chain extenders, cross linkers, catalysts and surfactants.

The amount of the curable component may vary based upon a number of factors, including whether the curing agent acts as a catalyst or participates directly in crosslinking of the curable composition, the concentration other reactive groups in the curable composition, the desired curing rate, the temperature of use, and the like.

For example, a lesser amount of curable component may be used at lower operating temperatures, while a greater amount of curable component typically may be used at higher operating temperatures. The amount of curable component suitable for use in the curable composition may be in the range of about 20 to about 80 percent by weight, more specifically about 40 to about 60 percent by weight, desirably about 45 to about 55 percent by weight, based on the total weight of the curable composition.

The thermally conductive component present in the curable composition and may also be selected based on the desired properties of the curable composition. In one useful embodiment, the thermally conductive component may be selected from graphite, alumina, aluminum, gold, copper, zinc oxide, titanium oxide, silicon carbide, silicon nitride, boron nitride, beryllium oxide, diamond, boron nitride, silver, copper, carbon, or various combinations thereof.

The amount of thermally conductive component may also be selected based on the desired properties of the curable composition. In one useful embodiment the thermally conductive component may be present in an amount of about 1 to about 40 percent by weight based on the total weight of the curable composition, more specifically about 5 to about 25 percent by weight based on the total weight of the curable composition, or desirably about 10 percent by weight based on the total weight of the curable composition. The thermally conductive component may be present in the curable composition in the form of nanoparticles.

The phase change material ("PCM") should be selected such that a phase change from solid or non-flowable to liquid or flowable occurs within a desired temperature range. Accordingly, the PCM may be selected based on the fluid in the hollow tube, the operating temperature of the hollow tube, and the ambient temperature. In order to select a PCM for a specific application, the operating temperature of the device should be considered and the PCM should be chosen to match.

A wide variety of PCMs may be used in the inventive curable composition.

A PCM for use herein may be encapsulated or dispersed within a matrix. For a general review of encapsulated PCMs, see e.g. P. B. Salunkhe et al., "A review on effect of phase change material encapsulation on the thermal performance of a system", *Renewable and Sustainable Energy Reviews,* 16, 5603-16 (2012).

PCMs suitable for use herein may be organic or inorganic. For instance, desirable PCMs include paraffin, fatty acids, esters, alcohols, glycols, organic eutectics, petrolatum, beeswax, palm wax, mineral waxes, glycerin and/or certain vegetable oils. The phase change material may also comprise salt hydrates and/or low melting metal eutectics.

A PCM that is particularly desirable for use in the curable composition herein may comprise about 75 to about 95 percent by weight of paraffin wax within a polymeric shell or more particularly about 85 to about 90 percent by weight of paraffin wax within a polymeric shell.

The paraffin may be a standard commercial grade and should include a paraffin wax having a melting point below about 40° C. Use of such a paraffin wax permits the matrix to transition from its solid to liquid state at a temperature below about 37° C. In addition to paraffin, as noted above, petrolatum, beeswax, palm wax, mineral waxes, glycerin and/or certain vegetable oils may be used to form a PCM. For instance, the paraffin and petrolatum components may be blended together such that the by weight ratio of such components (i.e., paraffin to petrolatum) is between about 1.0:0 to 3.0:1. In this regard, as the petrolatum component is increased relative say to the paraffin component, the PCM should increase in softness.

Commercially available representative PCMs include MPCM-32, MPCM-37, MPCM-52 and Silver Coated MPCM-37, where the number represents the temperature at which the PCM changes phase from solid to liquid. Suppliers include Entropy Solutions Inc., Plymouth, MN whose PCMs are sold under the Puretemp tradename; Microtek Laboratories, Inc., Dayton, OH; and Croda whose PCMs are sold under the CRODATHERM tradename. Microtek describes the encapsulated PCMs as consisting of an encapsulated substance with a high heat of fusion. The phase change material absorbs and releases thermal energy in order to maintain a regulated temperature within a product such as textiles, building materials, packaging, and electronics. If the PCM is encapsulated, the capsule wall or shell provides a microscopic container for the PCM. Even when the core is in the liquid state, the capsules still act as a solid-keeping the PCM from "melting away." Croda International plc, UK describes the encapsulated PCMs as CrodaTherm Microencapsulated Phase Change Materials which are durable core-shell particles that can be used in applications where a particle form of PCM is needed. As reported by the manufacturer, the CrodaTherm PCM is encapsulated in an acrylic shell so that when the bio-based core changes phase, the particle remains solid.

As the PCM undergoes its phase transition from a solid to a liquid state, the matrix absorbs heat until the matrix is transformed into the liquid state. As the PCM changes from a liquid to a solid state; the liquid state releases the absorbed heat until the PCM is transformed into solid state.

Depending on the application of the curable composition, the PCM may change phase from solid to liquid at a temperature in the range of about 25° C. to about 70° C., such as in the range of about 30° C. to about 40° C. In a particularly useful embodiment, the PCM has a melting temperature of about 39° C. In another useful embodiment, the PCM has a solidification temperature of about 34° C. And in still another embodiment that may be useful, the PCM has a solidification temperature of about 29° C. Further, the PCM should be stable against leakage up to a temperature of about 200° C.

The PCM may have a particle size in the range of about 15 μm to about 30 μm. It is desirable that the PCM is present in the curable composition in an amount of about 20 to about 80 percent by weight based on the total weight of the curable composition.

The cure system may comprise a curative and/or a free radical initiator. The cure system may comprise nitrogen-containing compounds, such as those selected from amine compounds, amide compounds, imidazole compounds, guanidine compounds, urea compounds and combinations thereof. The cure system may also comprise peroxides.

The amine compounds may be selected from, aliphatic polyamines, aromatic polyamines, alicyclic polyamines and combinations thereof. The amine compounds may be selected from diethylenetriamine, triethylenetetramine, diethylaminopropylamine, xylenediamine, diaminodiphenylamine, isophoronediamine, menthenediamine and combinations thereof.

Modified amine compounds may be used herein as well. Useful modified amine compounds include epoxy amine additives formed by the addition of an amine compound to an epoxy compound, for instance, novolac-type resin modified through reaction with aliphatic amines.

The imidazole compounds may be selected from imidazole, isoimidazole, alkyl-substituted imidazoles, and combinations thereof. More specifically, the imidazole compounds are selected from 2-methyl imidazole, 2-ethyl-4-methylimidazole, 2,4-dimethylimidazole, butylimidazole, 2-heptadecenyl-4-methylimidazole, 2-undecenylimidazole, 1-vinyl-2-methylimidazole, 2-n-heptadecylimidazole, 2-undecylimidazole, 1-benzyl-2-methylimidazole, 1-propyl-2-methylimidazole, 1-cyanoethyl-2-methylimidazole, 1-cyanoethyl-2-ethyl-4-methylimidazole, 1-cyanoethyl-2-undecylimidazole, 1-cyanoethyl-2-phenylimidazole, 1-guanaminoethyl-2-methylimidazole and addition products of an imidazole and trimellitic acid, 2-n-heptadecyl-4-methylimidazole, aryl-substituted imidazoles, phenylimidazole, benzylimidazole, 2-methyl-4,5-diphenylimidazole, 2,3,5-triphenylimidazole, 2-styrylimidazole, 1-(dodecyl benzyl)-2-methylimidazole, 2-(2-hydroxyl-4-t-butylphenyl)-4,5-diphenylimidazole, 2-(2-methoxyphenyl)-4,5-diphenylimidazole, 2-(3-hydroxyphenyl)-4,5-diphenylimidazole, 2-(p-dimethylaminophenyl)-4,5-diphenylimidazole, 2-(2-hydroxyphenyl)-4,5-diphenylimidazole, di(4,5-diphenyl-2-imidazole)-benzene-1,4, 2-naphthyl-4,5-diphenylimidazole, 1-benzyl-2-methylimidazole, 2-p-methoxystyrylimidazole, and combinations thereof.

Modified imidazole compounds may be used as well, which include imidazole adducts formed by the addition of an imidazole compound to an epoxy compound.

Guanidines, substituted guanidines, substituted ureas, melamine resins, guanamine derivatives, cyclic tertiary amines, aromatic amines and/or mixtures thereof. The hardeners may be involved stoichiometrically in the hardening reaction; they may, however, also be catalytically active. Examples of substituted guanidines are methyl-guanidine, dimethylguanidine, trimethylguanidine, tetra-methylguanidine, methylisobiguanidine, dimethylisobiguanidine, tetramethyliso-biguanidine, hexamethylisobiguanidine, heptamethylisobiguanidine and cyanoguanidine (dicyandiamide). Representative guanamine derivatives include alkylated benzoguanamine resins, benzoguanamine resins and methoxymethylethoxy-methylbenzoguanamine.

The cure system may be present in the curable composition in an amount of about 30 to about 50 percent by weight based on the total weight of the curable composition.

In addition, the cure system may be present in a separate part from the curable component. In this way, a two part composition may be configured, where the two parts are brought together shortly before application onto the coil.

Other components may also be included depending on the end use to which the inventive composition is intended. For instance, flame retardant materials and/or anti-oxidants may be included.

The curable composition may have a thermal conductivity of about 0.2 to about 1.2 W/m/K and a latent heat of fusion of about 60 to about 200 J/g, more specifically about 60 to about 120 J/g.

The ratio of thermal conductivity to latent heat of fusion of the curable composition is optimized to facilitate optimal heat transfer, storage, and dissipation. In particular, the curable composition may have a ratio of thermal conductivity to latent heat of fusion of about 0.06.

The curable composition described above may be coated onto the exterior surface of the hollow tube by conventional coating methods. This curable composition may modulate the "skin" temperature of the hollow tube, to minimize the temperature that the end user experiences from contact with the hollow tube when the hollow tube is in use, such as when the hollow tube is a condenser coil in a refrigeration unit.

The hollow tube described above may be included in a refrigeration unit shown in FIG. 1. The refrigeration unit may be a domestic refrigerating appliance or a commercial refrigerating appliance. The refrigeration unit includes a condenser coil 2, an evaporator coil 8, and a compressor 3. The refrigeration unit may further include a refrigeration compartment 1 and a flowmeter 4.

Specifically, the hollow tube of the present invention may be the condenser coil 2 in a refrigeration unit 1. The condenser coil 2 and may be straight, curved, or have straight sections and curved sections. Alternatively, the hollow tube of the present invention may be the evaporator coil 8 of the refrigeration unit.

A liquid is moved throughout the refrigeration unit in a closed system. The liquid may be aqueous or it may comprise one or more alkanes, such as branched alkanes and/or alkanes substituted with one or more halogen atoms. Examples of the branched alkanes include isobutane, tetrafluoroethane, and combinations thereof. The liquid may comprise one or more alkanes that may be branched and/or substituted with one or more halogen atoms. In a particularly useful embodiment, the liquid may be a refrigerant. Specifically, the refrigerant may be in liquid form when it enters the refrigeration unit.

Evaporator coil 8 may be disposed within the refrigeration compartment 1. The evaporator coil 8 may be a hollow tube with a liquid flowing therethrough. The evaporator coil 8 absorb heat from the air within the refrigeration compartment 1 to cool down the refrigeration compartment. Due to the heat absorbed from the refrigeration compartment 1, the liquid within the evaporator coil 8 transitions to gas form.

The liquid in gas form then passes from the evaporator coil 8 into a compressor 3 which increases the pressure of the gas. A flowmeter 4 may be downstream of the compressor 3 to monitor and control the flow rate of the liquid. The compressor 3 passes the pressurized gas to the condenser coil 2. The condenser coil 2 then removes heat from the gas, converting the gas back to liquid form before it is recycled to the refrigeration unit. The inlet temperature 5 and outlet temperature 6 of the condenser coil 2 may be measured. In a useful embodiment, the inlet temperature 5 is about 40° C. and the outlet temperature 6 is about 35° C.

Figure 3:
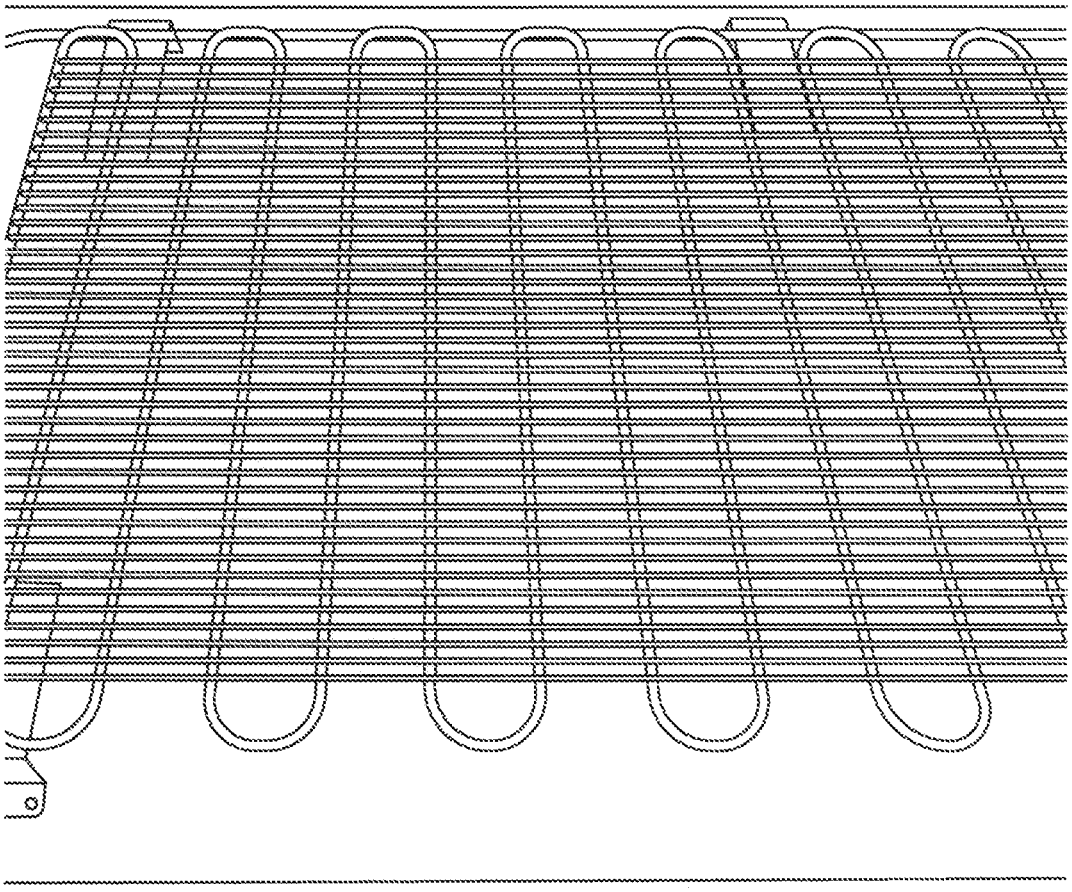
FIG. 3 depicts a condenser coil (bare).

The curable composition disclosed herein may be applied to both the condenser coil 2 and the evaporator coil 8. The curable composition absorbs enough heat to change the refrigerant to a liquid in the condenser coil 2 and absorbs heat from the refrigeration compartment 1 to more efficiently cool the refrigeration compartment 1. Accordingly, the PCM included in the curable composition applied to the condenser coil 2 and evaporator coil 8 may be varied based on the operating temperatures of each. Further, when the curable composition is applied to condenser coil 2 or the evaporator coil 8, it may reduce or eliminate the need for a fan (not shown) thereby enhancing the overall energy efficiency of the refrigeration unit. Reference to FIG. 3 shows a condenser coil before coating with a curable composition. The shown condenser coil is constructed from galvanized steel.

In addition, in a refrigeration unit, such as the refrigeration unit shown in FIG. 1, the ambient air around the condenser 7 is sufficient to re-solidify the PCM in the curable composition if it is applied to the condenser coil 2. Desirably, the curable composition may be varied to match the liquid used in the refrigeration unit, the operating temperature of the refrigeration unit, and which components of the refrigeration unit the curable composition is applied to.

Examples

Compositions were prepared according to the present invention comprising a curable component, a thermally conductive component, a phase change material, and a cure system. These compositions are listed in Table A. LOCTITE-branded E-30CL is a two part epoxy adhesive available commercially from Henkel Corporation, Rocky Hill, CT. Part B was used as is. To Part A was added one or more of EPODIL 749, MPCM 37D and Graphite 5095. EPODIL 749 is available commercially from Evonik Corporation, Parsippany, NJ, and is neopentyl glycol diglycidyl ether used to reduce the viscosity of epoxy resin systems.

TABLE A

| Sample No. | Part A/Amt (wt %) | Part B/Amt (wt %) |
|---|---|---|
| 1 | 35.7% Epoxy (E-30CL[1])/14.3% EPODIL 749/50% MPCM 37D[#] | 100% Epoxy Hardener (E-30CL[@]) |
| 2 | 60% Epoxy (E-30CL)/40% Graphite 5095 | 100% Epoxy Hardener (E-30CL) |

TABLE A-continued

| Sample No. | Part A/Amt (wt %) | Part B/Amt (wt %) |
|---|---|---|
| 3 | 24.19% Epoxy (E-30CL)/24.19% EPODIL 749/48.39% MPCM 37D/3.23% Graphite 5095 | 100% Epoxy Hardener (E-30CL) |

[1]Epichlorohydrin-4,4'-isopropylidene diphenol resin (90-100 wt %) and 4,4'-Methylenediphenol, polymer with 1-chloro-2,3-epoxypropane (0.1-1 wt %), as reported by the manufacturer.
[@]3,3'-Oxybis(ethyleneoxy)bis(propylamine) (50-60 wt %), as reported by the manufacturer.
[#]Docosane, as reported by the manufacturer.

Sample Nos. 1-3 were coated onto a coil (each coil having the same dimensions and constructed from the same material) to reach an add on level as noted in Table 1. Sample Nos. 1 and 2 were applied to the coil twice, at different add on levels; Sample No. 3 was applied to the coil three times, at different add on levels.

Latent heat measurements were done using a Perkin Elmer DSC 8000. Thermal conductivity measurements were done on a TA Instruments DTC-300 Thermal Conductivity tester following known standard ASTM F-433 which is based on the Standard Practice for Evaluating Thermal Conductivity of Gasketing Materials.

TABLE 1

| | | PCM Properties | | |
|---|---|---|---|---|
| Sample No. | Coil ID | Latent Heat [J/g] | Thermal Conductivity [W/mK] | Add on (grams) |
| 1 | C1 | High/ | Low/ | 440 |
| | C2 | 120 | 0.2 | 440 |
| 2 | B1 | Low/ | High/ | 400 |
| | B2 | 60 | 1.0-1.2 | 300 |
| 3 | A1 | Moderate/ | Moderate/ | 360 |
| | A2 | 100 | 0.4-0.6 | 360 |
| | A3 | | | 440 |

FIG. 1 shows the experimental equipment arrangement used in these examples. The condenser coil 2 was exposed to a constant ambient temperature 7 of 25° C.+/−0.1° C. and connected to a pump 3 and flowmeter 4. Water in the system was heated in the refrigeration compartment 1 to a constant temperature of 40° C. The water was then pumped through the condenser coil 2 at a controlled flow rate while holding the coil inlet temperature 5 constant at 40° C. and measuring the condenser coil outlet temperature 6. Measurements were taken at five different flow rates from 0.25 liters per minute and 0.75 liters per minute. Five cycles in flow of 10 minutes on followed by 18 minutes off were completed for each flow rate. Instantaneous power dissipation was calculated from flowrate, water density, water heat capacity, and the change in temperature across the condenser coil. Dissipated Energy was then calculated by integrating the dissipated power over time for each on/off flow cycle, and then summing the dissipated energies for each of the 5 flow cycles. Measurements and calculations were made for each of the five flow rates.

Figure 2:
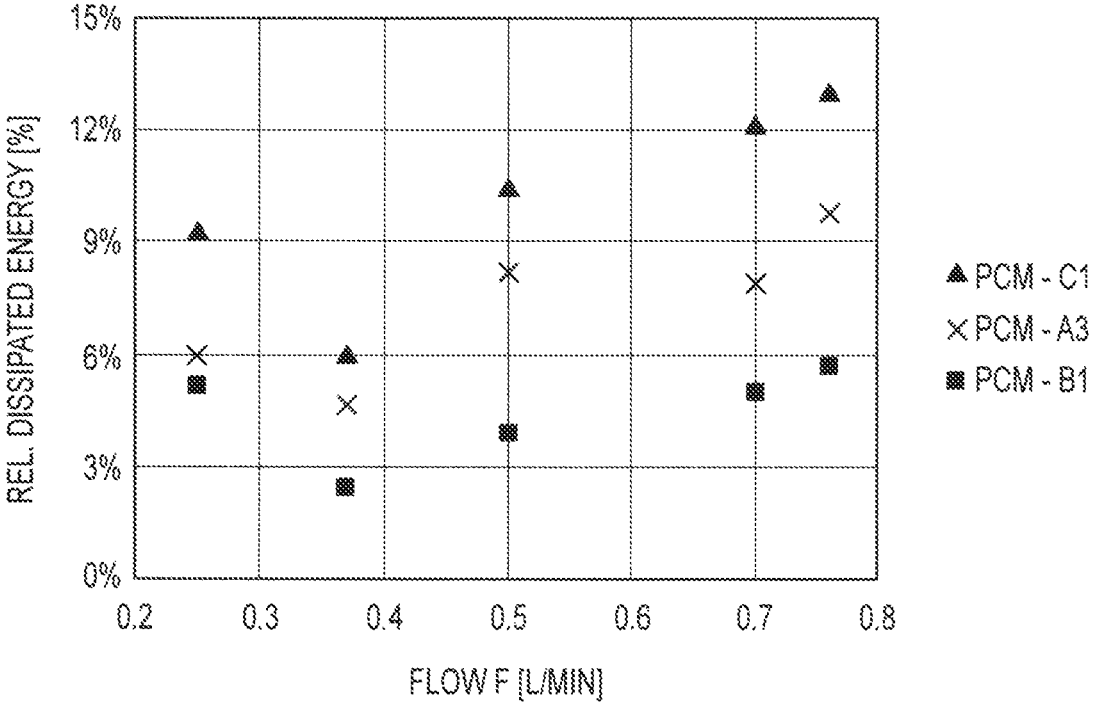
FIG. 2 depicts a plot of dissipated energy versus flow for three different coating compositions.

FIG. 2 shows results of relative energy dissipated from each of the evaluated coils. The output value of relative energy dissipated was calculated from the energy dissipated by the condenser coil coated with phase change material-containing composition as compared with a control, i.e., a condenser coil without such a phase change material-containing composition applied. In the case of a phase change material with low latent heat and high thermal conductivity, an improvement in dissipated energy of 4.4 percent over a control was observed. In the case of a phase change material with medium latent heat and medium thermal conductivity, an improvement of 7.3 percent over a control was observed. In the case of a phase change material with high latent heat and low thermal conductivity, an improvement of 10.2 percent versus a control was obtained.

Water-based compositions were prepared according to the present invention comprising a binder, a thermally conductive component, and a phase change material. These compositions are listed in Table B. EPS 2111 is an all acrylic binder that can be used in lamination adhesives, especially in blending with latex polychloroprene. The polymer has broad adhesion to various substrates and good 180° peel and heat resistance. It is available commercially from Engineering Polymer Solutions, Marengo, IL. To EPS 2111 was added water, MPCM 37D and Graphite 2939 in the amounts noted. Sample No. 4 contained 78 water; Sample No. 5 contained 8% water; and Sample No. 6 contained 13% water.

TABLE B

| Sample No. | Graphite 2939 | EPS 2111 | MPCM 43D |
|---|---|---|---|
| 4 | 21.2 | 47.7 | 24.1 |
| 5 | 33.3 | 42.5 | 16.2 |
| 6 | 3.1 | 33.1 | 50.8 |

While an acrylic binder was used in Sample Nos. 4-6, other types of polymer emulsions, or water based polymer solutions, may also be used. For instance, PUR dispersions, acrylic emulsions or solutions, and alkyd emulsions or solutions may also be used.

What is claimed is:

1. A hollow tube comprising two ends, one end adapted to receive a fluid and the other end adapted to discharge the fluid, wherein the hollow tube has an interior surface and an exterior surface, wherein a composition is disposed as a coating about at least a portion of the exterior surface of the hollow tube, wherein the composition comprises either:

A.
- i) a curable component;
- ii) a thermally conductive component;
- iii) a phase change material; and
- iv) a cure system; or B.
- i) a binder component;
- ii) a thermally conductive component;
- iii) a phase change material; and
- iv) water;

wherein the composition modulates the temperature an end user experiences from contact with the hollow tube while the hollow tube is in use.

2. The hollow tube of claim 1, wherein the hollow tube is constructed of metal.

3. The hollow tube of claim 2, wherein the metal is selected from aluminum, steel, copper, or combinations or alloys thereof.

4. The hollow tube of claim 1, wherein the composition further comprises an anti-oxidant, a corrosion inhibitor, a UV-stabilizer, a thermostabilizer, a flame retardant, or a combination thereof.

5. The hollow tube of claim 1, wherein the fluid is aqueous.

6. The hollow tube of claim 1, wherein the fluid comprises one or more alkanes.

7. The hollow tube of claim 1, wherein the fluid comprises one or more alkanes that are branched and/or substituted with one or more halogen atoms.

8. The hollow tube of claim 1, wherein the fluid comprises isobutane, tetrafluoroethane, and combinations thereof.

9. The hollow tube of claim 1, wherein the curable component comprises an epoxy resin, a polyurethane matrix, a hot melt, a silicon component, a (meth)acrylate, or a combination thereof.

10. The hollow tube of claim 1, wherein the curable component comprises an epoxy resin component selected from one or more saturated, unsaturated, cyclic or acyclic, aliphatic, alicyclic, aromatic or heterocyclic polyepoxide compounds.

11. The hollow tube of claim 1, wherein the curable component comprises a (meth)acrylate component selected from one or more monofunctional, multifunctional, linear aliphatic, branched aliphatic, cycloaliphatic, aromatic, alkoxylated alkyl and aryl groups.

12. The hollow tube of claim 1, wherein the curable component is present in an amount of 20 to 80 percent by weight based on the total weight of the curable composition.

13. The hollow tube of claim 1, wherein the thermally conductive component is selected from boron nitride, silver, copper, or carbon.

14. The hollow tube of claim 1, wherein the thermally conductive component is present in an amount of 1 to 40 percent by weight based on the total weight of the curable composition.

15. The hollow tube of claim 1, wherein the phase change material is encapsulated.

16. The hollow tube of claim 1, wherein the phase change material comprises a phase change material that changes phase from solid to liquid at a temperature in the range of 25° C. to 60° C.

17. The hollow tube of claim 1, wherein the phase change material comprises a phase change material that changes phase from solid to liquid at a temperature in the range of 30° C. to 40° C.

18. The hollow tube of claim 1, wherein the phase change material has a particle size in the range of 15 um to 30 um.

19. The hollow tube of claim 1, wherein the phase change material comprises paraffin, fatty acids, esters, alcohols, glycols, organic eutectics, petrolatum, beeswax, palm wax, mineral waxes, glycerin and/or certain vegetable oils.

20. The hollow tube of claim 1, wherein the phase change material comprises salt hydrates and/or metal eutectics.

21. The hollow tube of claim 1, wherein 95 percent or more of the exterior surface of the hollow tube is coated with the composition.

* * * * *